US011548605B2

(12) United States Patent
Husberg

(10) Patent No.: US 11,548,605 B2
(45) Date of Patent: Jan. 10, 2023

(54) MARINE VESSEL PROPULSION UNIT CALIBRATION METHOD

(71) Applicant: VOLVO PENTA CORPORATION, Gothenburg (SE)

(72) Inventor: Tobias Husberg, Kareby (SE)

(73) Assignee: VOLVO PENTA CORPORATION, Gothenburg (SE)

( * ) Notice: Subject to any disclaimer, the term of this patent is extended or adjusted under 35 U.S.C. 154(b) by 423 days.

(21) Appl. No.: 16/630,285

(22) PCT Filed: Jul. 14, 2017

(86) PCT No.: PCT/EP2017/067882
§ 371 (c)(1),
(2) Date: Jan. 10, 2020

(87) PCT Pub. No.: WO2019/011445
PCT Pub. Date: Jan. 17, 2019

(65) Prior Publication Data

US 2020/0361587 A1 Nov. 19, 2020

(51) Int. Cl.
*B63H 25/42* (2006.01)
*B63H 5/125* (2006.01)
(Continued)

(52) U.S. Cl.
CPC ..... *B63H 25/42* (2013.01); *B63H 5/125* (2013.01); *B63H 25/02* (2013.01);
(Continued)

(58) Field of Classification Search
CPC ..... B63H 25/42; B63H 5/125; B63H 25/02; B63H 2020/003; B63H 2021/216; B63H 2025/425
(Continued)

(56) References Cited

U.S. PATENT DOCUMENTS 7,769,504 B2 * 8/2010 Kaji ..... B63H 20/12 701/99
8,117,890 B1 2/2012 Durmeyer et al.
(Continued)

FOREIGN PATENT DOCUMENTS

CN 102458979 A 5/2012
CN 104736431 A 6/2015
(Continued)

OTHER PUBLICATIONS

International Search Report and Written Opinion dated Mar. 12, 2018 in International Application No. PCT/EP2017/067882, 9 pages.

*Primary Examiner* — Anthony D Wiest
(74) *Attorney, Agent, or Firm* — Venable LLP; Jeffri A Kaminski

(57) ABSTRACT

A calibration method for at least one propulsion unit of a marine vessel, the at least one propulsion unit being arranged to provide a propulsive force to the vessel, the at least one propulsion unit being adjustable so as to change a respective steering angle of the at least one propulsion unit in relation to a hull of the vessel. The method includes controlling the at least one propulsion unit so as to provide at least one acceleration sequence, wherein the vessel is accelerated stepwise or continuously in each acceleration sequence, adjusting, continuously or repeatedly, during the acceleration sequence, the steering angle of the at least one propulsion unit, to keep the path of the vessel straight during the acceleration sequence, registering, during the acceleration sequence, a plurality of values of the respective steering angle of the at least one propulsion unit, and determining, based at least partly on the registered steering angle values, a respective reference steering angle of the at least one propulsion unit, which reference steering angle minimizes a
(Continued)

deviation of an actual course over ground of the vessel from a desired course over ground of the vessel.

25 Claims, 8 Drawing Sheets

(51) Int. Cl.
*B63H 25/02* (2006.01)
*B63H 20/00* (2006.01)
*B63H 21/21* (2006.01)

(52) U.S. Cl.
CPC .. *B63H 2020/003* (2013.01); *B63H 2021/216* (2013.01); *B63H 2025/425* (2013.01)

(58) Field of Classification Search
USPC ..... 701/21
See application file for complete search history.

(56) References Cited

U.S. PATENT DOCUMENTS

| | | | | |
|---|---|---|---|---|
| 8,150,569 | B2 * | 4/2012 | Kaji ..... | B63H 20/12 701/99 |
| 2007/0046241 | A1 | 3/2007 | Pettersson | |
| 2011/0028057 | A1 | 2/2011 | Torrångs et al. | |
| 2016/0288893 | A1 | 10/2016 | Rydberg et al. | |

FOREIGN PATENT DOCUMENTS

| | | | |
|---|---|---|---|
| EP | 2064607 | A1 | 6/2009 |
| EP | 3100945 | A1 | 12/2016 |
| WO | 2007030040 | A1 | 3/2007 |

* cited by examiner

| t | AAC | ABC | HD | AA | AB | DA | HA | ACC |
|---|---|---|---|---|---|---|---|---|
| | | | | | | | | |
| t1 | AAC1 | ABC1 | HD1 | .. | .. | .. | .. | .. |
| t2 | AAC1 | ABC1 | HD1 | .. | .. | .. | .. | .. |
| t3 | AAC1 | ABC1 | HD1 | .. | .. | .. | .. | .. |
| t4 | AAC1 | ABC1 | HD1 | .. | .. | .. | .. | .. |
| t5 | AAC1 | ABC1 | HD1 | .. | .. | .. | .. | .. |
| t6 | AAC1 | ABC1 | HD1 | .. | .. | .. | .. | .. |
| .. | .. | .. | .. | .. | .. | .. | .. | .. |
| .. | .. | .. | .. | .. | .. | .. | .. | .. |
| T | AAC1 | ABC1 | HD2 | .. | .. | .. | .. | .. |
| T+1 | AAC1 | ABC1 | HD2 | .. | .. | .. | .. | .. |
| T+2 | AAC1 | ABC1 | HD2 | .. | .. | .. | .. | .. |
| T+3 | AAC1 | ABC1 | HD2 | .. | .. | .. | .. | .. |
| T+4 | AAC1 | ABC1 | HD2 | .. | .. | .. | .. | .. |
| .. | .. | .. | .. | .. | .. | .. | .. | .. |
| .. | .. | .. | .. | .. | .. | | .. | .. |
| .. | .. | .. | .. | .. | .. | | .. | |

FIG. 6

MARINE VESSEL PROPULSION UNIT CALIBRATION METHOD

TECHNICAL FIELD

The invention relates to a calibration method for at least one propulsion unit of a marine vessel. The invention also relates to a computer program, a computer readable medium, a control unit, a marine propulsion control system, and a marine vessel.

The invention is not restricted to any particular type of marine vessel. Instead it may be used on any type and any size of marine vessel, water surface vessels as well as submarines.

BACKGROUND

In a marine vessel production, one or more propulsion units of a vessel may need to be inspected so as to find a center steering angle of the respective propulsion unit, presumed to provide a straight path of travel of the vessel. Each center steering angle may simply be a respective angular position which is midways between two extreme positions of the respective propulsion unit. Finding this position may be done e.g. by laser positioning tools. The center steering angle may assist the control of the vessel in numerous operational situations, such as low speed operations, at sport fishing and/or a joystick control mode of the vessel.

A marine vessel propulsion unit calibration method is known from U.S. Pat. No. 8,117,890. The method involves changing a steering alignment of two propulsion units, by a known and symmetrical amount in order to identify and characterize the effect that such a change has on the operating efficiency of the marine vessel.

There is nevertheless a remaining desire to improve known marine vessel propulsion unit calibration methods.

SUMMARY

An object of the invention is to improve known marine vessel propulsion unit calibration methods.

The object is reached with a method according to claim 1. Thus, the object is reached with a calibration method for at least one propulsion unit of a marine vessel, the at least one propulsion unit being arranged to provide a propulsive force to the vessel, the at least one propulsion unit being adjustable so as to change a respective steering angle of the at least one propulsion unit in relation to a hull of the vessel, the method comprising

- controlling the at least one propulsion unit so as to provide at least one acceleration sequence, wherein the vessel is accelerated stepwise or continuously in each acceleration sequence,
- adjusting, continuously or repeatedly, during the acceleration sequence, the steering angle of the at least one propulsion unit, to keep the path of the vessel straight during the acceleration sequence,
- registering, during the acceleration sequence, a plurality of values of the respective steering angle of the at least one propulsion unit, and
- determining, based at least partly on the registered steering angle values, a respective reference steering angle of the at least one propulsion unit, which reference steering angle minimizes a deviation of an actual course over ground of the vessel from a desired course over ground of the vessel.

It is understood that the at least one propulsion unit may be arranged to provide the propulsive force to the vessel by delivering a thrust to water in which the vessel is floating. The steering angle of the at least one propulsion unit may be an angle of the propulsive force in relation to the hull.

The method may comprise determining, before controlling the at least one propulsion unit so as to provide at least one acceleration sequence, a respective base steering angle of the at least one propulsion unit, presumed to provide a straight path of travel of the vessel. Thereby, the reference steering angle may reduce, in relation to the base steering angle, the deviation of the actual course over ground of the vessel from the desired course over ground of the vessel. It is understood that the base steering angle of the at least one propulsion unit, may be assumed to provide an actual course over ground of the vessel, at straight travel, which is identical to the desired course over ground of the vessel. As suggested, the base steering angle may simply be an angular position which is midways between two extreme positions of the respective propulsion unit. However, due to circumstances, such as asymmetries of the vessel, e.g. in the weight distribution or the vessel geometry, "rudder effects" from a keel of the vessel, and fouling of the vessel hull, the base steering angle may not provide a straight path of travel of the vessel.

Where the method comprises more than one acceleration sequence, the vessel may be accelerated continuously in all of the sequences, or stepwise in all of the sequences. In some embodiments, where the method comprises more than one acceleration sequence, the vessel may be accelerated continuously in one or more of the sequences, and stepwise in one or more of the sequences.

The acceleration sequence may include all vessel speeds of the capacity of the vessel. I.e. the acceleration sequence may involve accelerating the vessel from zero speed to maximum speed. However, alternatively, the acceleration sequence may include a part of the interval from zero speed to maximum speed. For example, the acceleration sequence may involve accelerating the vessel from zero speed to a transition to a planing mode of operation of the vessel. As another example, the acceleration sequence may involve accelerating the vessel from a planing mode of operation of the vessel to a cruise speed or a maximum speed of the vessel.

Regardless whether an acceleration sequence involves continuous or stepwise acceleration, the adjustment of the steering angle of the at least one propulsion unit may be done continuously or repeatedly. Where the adjustment of the steering angle is done repeatedly, the steering angle may be changed, and left to be constant, before being changed again.

The adjustment of the steering angle to keep the path of the vessel straight may be done by an autopilot, or by a person via a user control device, such as a steering wheel.

At different speeds with the same heading, the vessel may be subjected to side forces of different sizes. For example, where the vessel is capable of planing, the side forces due to water currents may be different at planing travel than at displacement travel, e.g. due to different volumes of the vessel hull being submerged in the water. The acceleration sequence, the steering angle adjustments, and the steering angle registrations, provides for selecting the reference steering angle in an optimal manner. The reference steering angle may minimize changes of the actual course over ground during an acceleration of the vessel. By gathering steering angles throughout the acceleration sequence, differences in side forces from current and wind at different speeds can be taken into account.

The invention provides a method for performing a calibration of the vessel propulsion unit(s) that may provide a high level of accuracy with a small amount of man hours. The method is performed while driving the vessel, and does not require the vessel to be kept out of the water. Compared to known solutions, e.g. such using laser positioning tools, etc., the method is not dependent on a visual contact when performing the method. Further, the method does not require any level of craftsmanship. The method may be used for new vessel production, as well as during a service and repair process involving a replacement or re-installation of one or more of the at least one propulsion units, or a part thereof.

Each of the propulsion units may comprise at least one propeller. The method is advantageously used where the at least one propulsion unit is a pod drive, or a stern drive. Thereby, each propulsion unit may have a single propeller, or two propellers, which may be counter-rotating. However, the method may be used also for other types of propulsion units, such as water jets, and propeller and rudder combinations. The method may be used where the vessel comprises a plurality of propulsion units, and also where the vessel comprises a single propulsion unit.

Preferably, the respective reference steering angle is determined by a statistical treatment of the registered steering angle values. The method may comprise repeatedly or continuously registering changes of the actual course over ground of the vessel during the acceleration sequence. The changes of the actual course over ground may be results of the acceleration and the steering angle adjustments. Determining the respective reference steering angle may comprise weighting the registered steering angle values, in dependence on respective deviations, at the registrations of the respective steering angle values, from a straight path of the vessel.

Thus, respective reference steering angle may be determined using a statistical algorithm. As suggested, the side forces or the drift, due to water currents and/or wind, may vary at different velocities of the vessel. A reason may be that the drift depends on the displacement, which varies depending on the vessel velocity. Embodiments of the invention thus provides, in addition to one or more acceleration sequences, a statistical test scheme allowing the provision of a reference steering angle that minimizes the influence of vessel speed variations on the drift.

Preferably, the method comprises selecting a first course over ground, and adjusting, continuously or repeatedly, during a first acceleration sequence, the steering angle of the at least one propulsion unit to align the actual course over ground of the vessel with the first course over ground. Thus, the course over ground may be constant during the acceleration sequence. Thereby, the method will be simple to implement. In alternative embodiments, the desired course over ground may change during an acceleration sequence. A change of the desired course over ground may be a result of a control unit, arranged to control the steering angle, being programmed so as for keeping the vessel at running straight. Thereby, a deviation from a first course over ground might be caused by the vessel turning, and a steering angle adjustment may be made to straighten the path of the vessel, providing a new course over ground.

Preferably, the method comprises selecting a second course over ground different from the first course over ground, and adjusting, continuously or repeatedly, during a second acceleration sequence, the steering angle of the at least one propulsion unit to align the actual course over ground of the vessel with the second course over ground.

Thus, the method may comprise a plurality of acceleration sequences with different courses over ground. Thereby, steering angle registrations may be obtained for different directions of currents and wind. This allows for a statistical treatment of the registered steering angle values to reach a higher level of accuracy for determining the reference steering angle.

Preferably, where the marine vessel comprises a first propulsion unit and a second propulsion unit, the method comprises adjusting, continuously or repeatedly, during at least one of the at least one acceleration sequence, a difference of the steering angles of the first and second propulsion units. For this, the steering angles may be individually controllable. The difference of the steering angles of the first and second propulsion units may be a mutual relation of the steering angles of the propulsion units. The adjustment of the steering angle of the propulsion units, to keep the path of the vessel straight during the acceleration sequence, may be at least partly done by the adjustment of the steering angle difference. Thereby, in addition to determining the reference steering angles as minimizing changes of the actual course over ground during an acceleration of the vessel, it is possible to avoid a difference of the steering angles that decreases the performance of the vessel, e.g. by providing counteracting thrusts which do not contribute to the propulsion of the vessel.

Preferably, the method comprises registering during the at least one of the at least one acceleration sequence a plurality of values of an operational parameter which is dependent on the steering angle difference, wherein the respective reference steering angles is determined based partly on the registered operational parameter values. Determining the respective reference steering angles may comprise comparing the operational parameter values registered at different steering angle differences.

Determining the respective reference steering angles may comprise comparing operational parameter values which are registered at different points in time, at different steering angle differences, and at respective vessel speeds which are substantially the same. Thereby, the operational parameter may be the vessel acceleration, the rotational speed of an internal combustion engine arranged to drive the first and/or the second propulsion unit, or a parameter indicative of the vessel acceleration, or the engine rotational speed. An example of a parameter indicative of the vessel acceleration may be the vessel speed where the acceleration is determined based on changes of the speed. An example of a parameter indicative of the engine rotational speed may be the rotational speed of a part, e.g. a shaft, of a drivetrain between the engine and the respective propulsion unit.

Thereby, the reference steering angles may be selected with a steering angle difference that maximizes the efficiency of the propulsion units, by minimizing any counteracting thrust components of the propulsion units. Comparing e.g. the vessel acceleration, or the engine rotational speed, registered at different points in time at which the vessel speed is substantially the same, an advantageous manner of determining an efficient steering angle difference is provided. A maximally efficient steering angle difference may maximize the acceleration of the vessel. A steering angle difference that maximizes the efficiency of the propulsion units may be such that the propulsion units are substantially parallel. However, in some embodiments, e.g. due to the geometry of the hull of the vessel, a steering angle difference that maximizes the efficiency of the propulsion units, and hence the acceleration of the vessel, may be such that the propulsion units are non-parallel.

In some embodiments, the compared operational parameter values may be registered during the same acceleration sequence. This may be done for example in a vessel with a relatively slow acceleration, for example a large and heavy boat or ship, since the difference between the vessel speeds at the points in time when the registrations were made may be relatively small.

In some embodiments, determining the respective reference steering angles comprises comparing operational parameter values which are registered at different points in time, at different steering angle differences, and at respective rotational speeds of an internal combustion engine or a drivetrain part, such as a drivetrain shaft, arranged to drive the first and/or the second propulsion unit, which are substantially the same. Thereby, the operational parameter may be the vessel speed, or a parameter indicative of the vessel speed. Comparing the vessel speed, or a parameter indicative of the vessel speed, registered at different points in time at which the engine or drivetrain part rotational speed is the same, provides an alternative manner of determining an efficient steering angle difference.

In some embodiments the method comprises selecting a first course over ground for a first acceleration sequence, and a second course over ground for a second acceleration sequence, wherein determining the respective reference steering angles comprises comparing operational parameter values which are registered at a respective of the first and second acceleration sequences. Thereby, the operational parameter values, which are registered at a respective of the first and second acceleration sequences, may be registered at respective vessel speeds which are substantially the same. Thus, the compared operational parameter values may be registered during different acceleration sequences. This may be done for example in a vessel with a relatively high acceleration, such as a power boat.

In some embodiments, the operational parameter values, which are registered at a respective of the first and second acceleration sequences, are registered at respective rotational speeds of an internal combustion engine or a drivetrain part, arranged to drive the first and/or the second propulsion unit, which are substantially the same. As suggested above, thereby the operational parameter may be the vessel speed, or a parameter indicative of the vessel speed. Thereby, an advantageous alternative is provided, e.g. for cases where the vessel presents a relatively high acceleration.

Preferably, each of at least some of the operational parameter values are registered substantially simultaneously with the registration of a respective of at least some of the steering angle values. Thereby, an advantageous correlation between the registered operational parameter values and the registered steering angle values may be obtained. This may increase the accuracy of the determination of the reference steering angles.

Preferably, determining the respective reference steering angles comprises weighting the steering angle values, in dependence on the respective operational parameter value registered substantially simultaneously with the registration of the respective steering angle value. Thereby, a secure statistical selection of an optimal reference steering angle may be obtained.

As suggested, the adjustment of the steering angle to keep the path of the vessel straight, may be done by an autopilot, or by a person via a user control device, such as a steering wheel. The adjustments of the difference of the steering angles of the first and second propulsion units may be done by a control unit arranged to control the steering angles.

In some embodiments, the method comprises determining, based at least partly on the registered steering angle values, a plurality of respective reference steering angles of the at least one propulsion unit, which reference steering angles minimizes, at a respective speed of the vessel, a deviation of an actual course over ground of the vessel from a desired course over ground of the vessel. In some embodiments, the reference speed angles may form parts of a continuous function mapping the respective reference steering angle to the vessel speed. In some embodiments, there could, for each propulsion unit, be a limited number of reference steering angles, each mapped to a respective vessel speed interval. For example, there could be a first reference steering angle for speeds below a planing mode of operation of the vessel, and there could be a second reference steering angle for speeds in the planing more of operation.

It is understood that where the marine vessel comprises a first propulsion unit and a second propulsion unit, the plurality of respective reference steering angles may, for each of a plurality of vessel speeds, provide pairs of reference steering angles for the first and second propulsion units. It is thus understood that the steering angle difference may be dependent on the vessel speed.

The object is also reached with a computer program according to claim 22, a computer readable medium according to claim 23, a control unit according to claim 24, a marine propulsion control system according to claim 25, or a marine vessel according to claim 26.

Further advantages and advantageous features of the invention are disclosed in the following description and in the dependent claims.

BRIEF DESCRIPTION OF THE DRAWINGS

With reference to the appended drawings, below follows a more detailed description of embodiments of the invention cited as examples. In the drawings:

FIG. 6 shows a table with parameters stored in the marine propulsion control system during the execution of the method in FIG. 5.

DETAILED DESCRIPTION OF EXAMPLE EMBODIMENTS OF THE INVENTION

Figure 1:
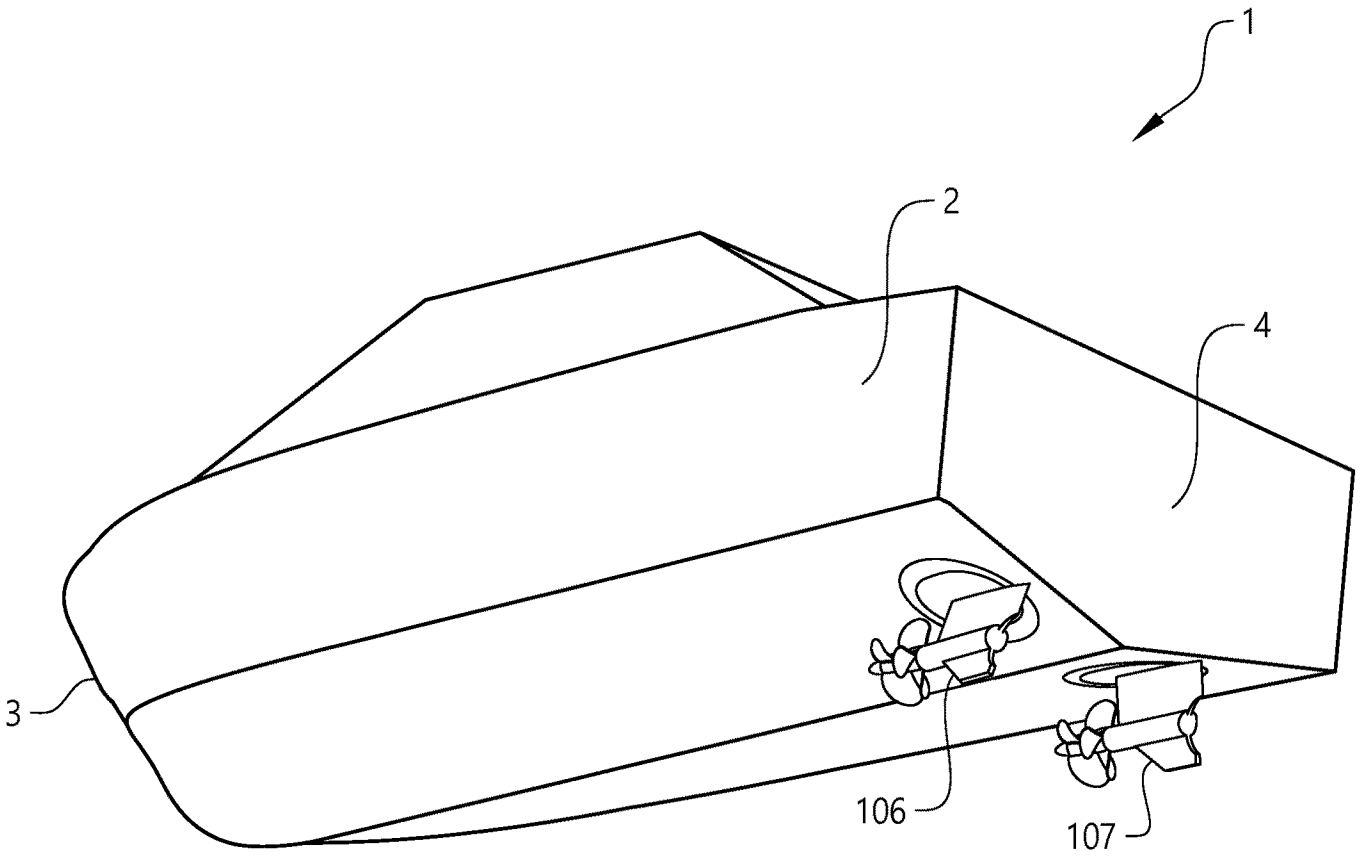
FIG. 1 is a perspective view of a marine vessel.

FIG. 1 shows a marine vessel 1 in the form of a power boat, presenting a bow 3 and a stern 4. Generally, a marine propulsion control system according to an embodiment of the inventive concept may be used in any type of water surface vessel, such as a large commercial ship, a boat for transport of goods and/or people, a leisure boat or another type of marine vessel.

The marine vessel comprises a first propulsion unit 106 and a second propulsion unit 107. The propulsion units 106, 107 protrude from a lower side of a hull 2 of the vessel 1. The first and second propulsion units 106, 107 are in this example respective pod drives. Each propulsion unit 106, 107 is arranged to deliver thrust to water in which the vessel 1 is floating to thereby provide a propulsive force to the vessel. For this each propulsion unit 106, 107 comprises, in this example, two coaxial and counter-rotating propellers. It should be noted that the invention is equally applicable to other types of propulsion units, such as stern drives, fixed propeller and rudder combinations, or outboard engines.

Figure 2:
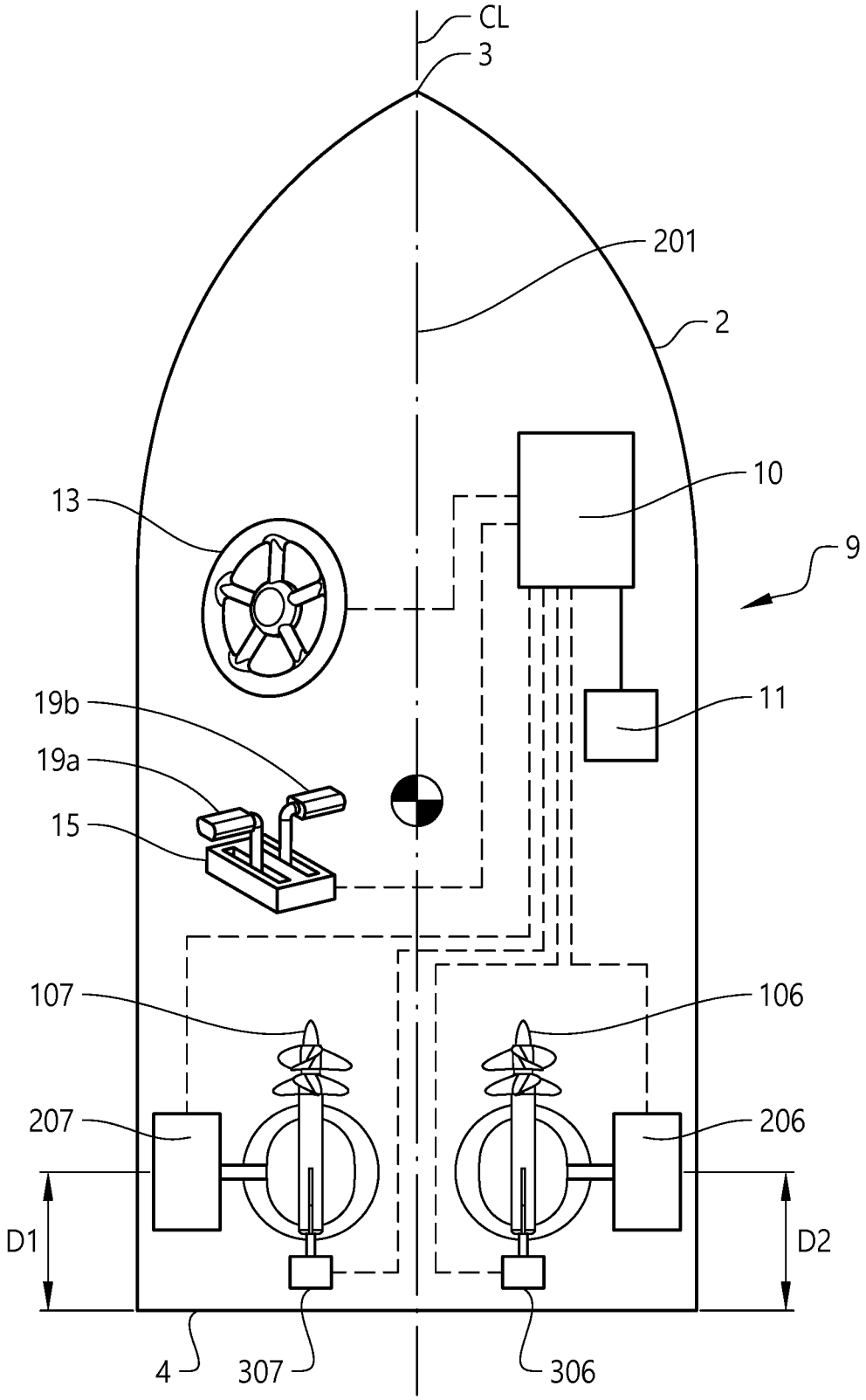
FIG. 2 is a view of the vessel in FIG. 1 from underneath, with some components of a marine propulsion control system indicated schematically.

FIG. 2 shows the boat 1 from underneath. The hull is a V-hull, and a keel 201 extends along a longitudinal centreline CL of the hull.

The control of the propulsion units 106, 107 are performed by a marine propulsion control system 9. The control system includes a control unit 10, which may be provided as one physical unit, or a plurality of physical units arranged to send and receive control signals to and from each other. The control unit 10 may comprise computing means such as a CPU or other processing device, and storing means such as a semiconductor storage section, e.g., a RAM or a ROM, or such a storage device as a hard disk or a flash memory. The storage section can store settings and programs or schemes for interpreting input commands and generating control commands for controlling the propulsion units 106, 107.

Two internal combustion engines 206, 207 are provided in the vessel, each arranged to drive, via respective drivetrains, the propellers of a respective of the propulsion units 106, 107. The drivetrains may each comprise one or more shafts and one or more gear sets. The output torque of the engines 206, 207 can be controlled individually by the control unit 10. Thereby, the thrust delivery levels of the propulsion units 106, 107 are individually controllable. In alternative embodiments, the propellers may be driven by e.g. electric motors.

Two steering actuators 306, 307, which are controllable by the control unit 10, are arranged to rotate a respective of the propulsion units 106, 107 in relation to the hull 2 around a respective steering axis, which may be substantially vertical. Thus, the propulsion units 106, 107 are adjustable so as to individually change a respective steering angle of the propulsion units in relation to the hull 2. The steering actuators 306, 307 may include e.g. a hydraulic cylinder or an electrical motor.

A user command input device (not shown) is provided in the form of a switch, which is arranged to be manipulated by a user, so as to selectively activate an autopilot 11. The autopilot 11 is arranged to receive input commands from a user regarding a desired course over ground, and to use signals from the Global Positioning System (GPS) to provide signals to the control unit 10 for adjustments of the steering angles of the propulsion units 106, 107. Thus, the control unit 10 is arranged to adjust the steering angles of the propulsion units 106, 107 to align an actual course over ground of the vessel with the desired course over ground.

In addition, the control unit 10 is arranged to select gears of the propulsion units, e.g. between forward, reverse, and neutral gears.

The control system further includes user command input devices including a steering wheel 13, and a thrust regulator 15. The control unit 10 is arranged to receive control signals from the user command input devices 13, 15.

The control unit 10 may thus control operations of the propulsion units, through controlling individually for each of the propulsion units, the gear selection, delivered thrust and steering angle. The controlled operations are based at least partly on the input commands from the autopilot 11 and the user command input devices 13, 15.

Control signals in the control system may be sent through communication lines or wirelessly.

Below an embodiment of a calibration method for the steering angles of the propulsion units 106, 107 will be described. Such a calibration may be needed for various reasons. For example, a production boat is usually not perfectly symmetrical. For example, there may be deviations from intended symmetrical positions of the propulsion units. E.g. the distances of the propulsion units 106, 107 from the stern 4, as indicated in FIG. 2 with the double arrows D1 and D2, may be dissimilar.

Figure 3:
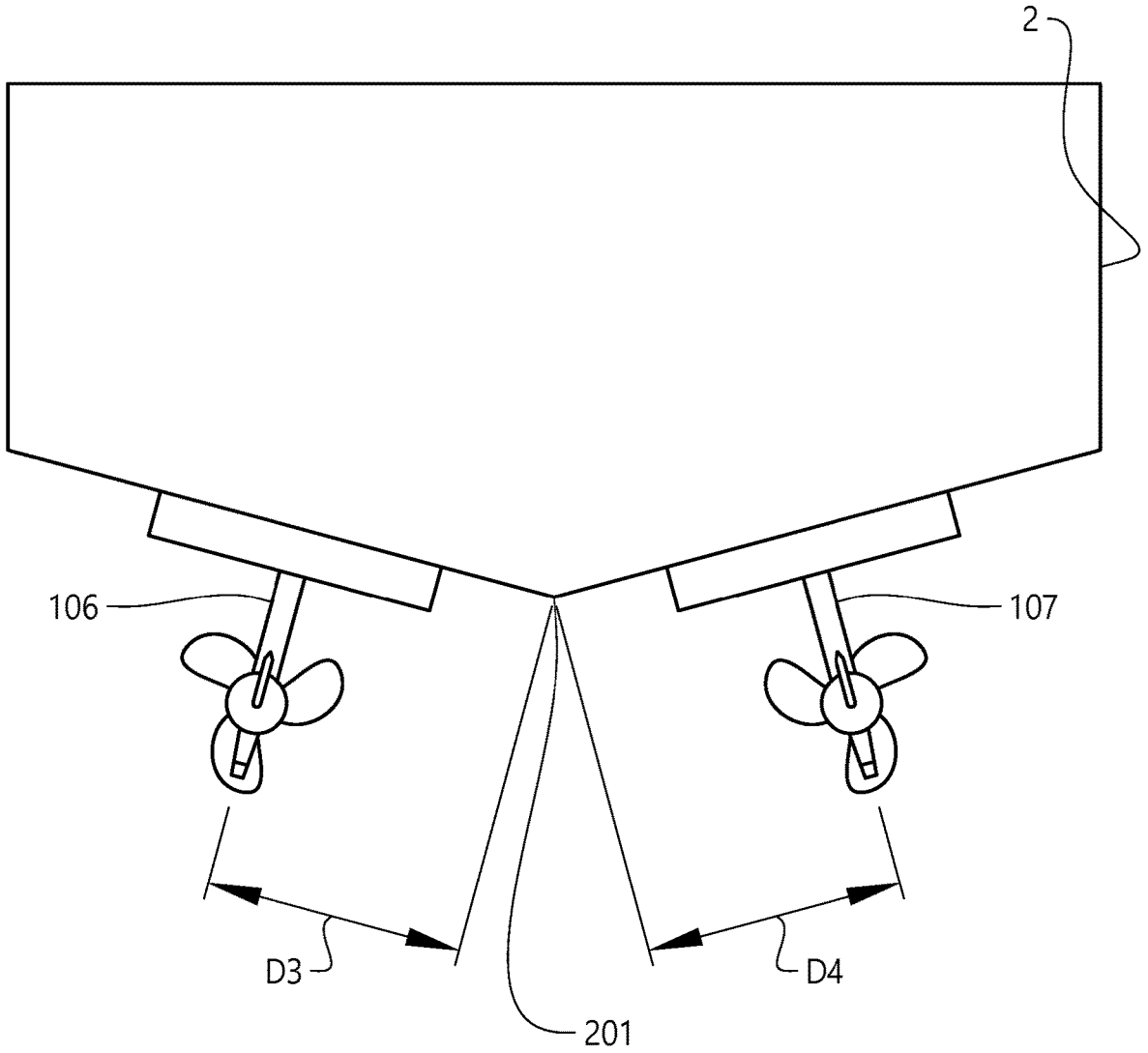
FIG. 3 is a view of the vessel in FIG. 1 from behind a stern of the vessel.

Further, as indicated with the double arrows D3 and D4 in FIG. 3, the distances of the propulsion units 106, 107 from the keel 201 may be dissimilar. In addition, the weight distribution of the boat 1 may be asymmetrical with respect to the centreline CL. Also, as discussed below, centre positions of the propulsion units may to different degrees divert from the hull centreline CL.

Figure 4:
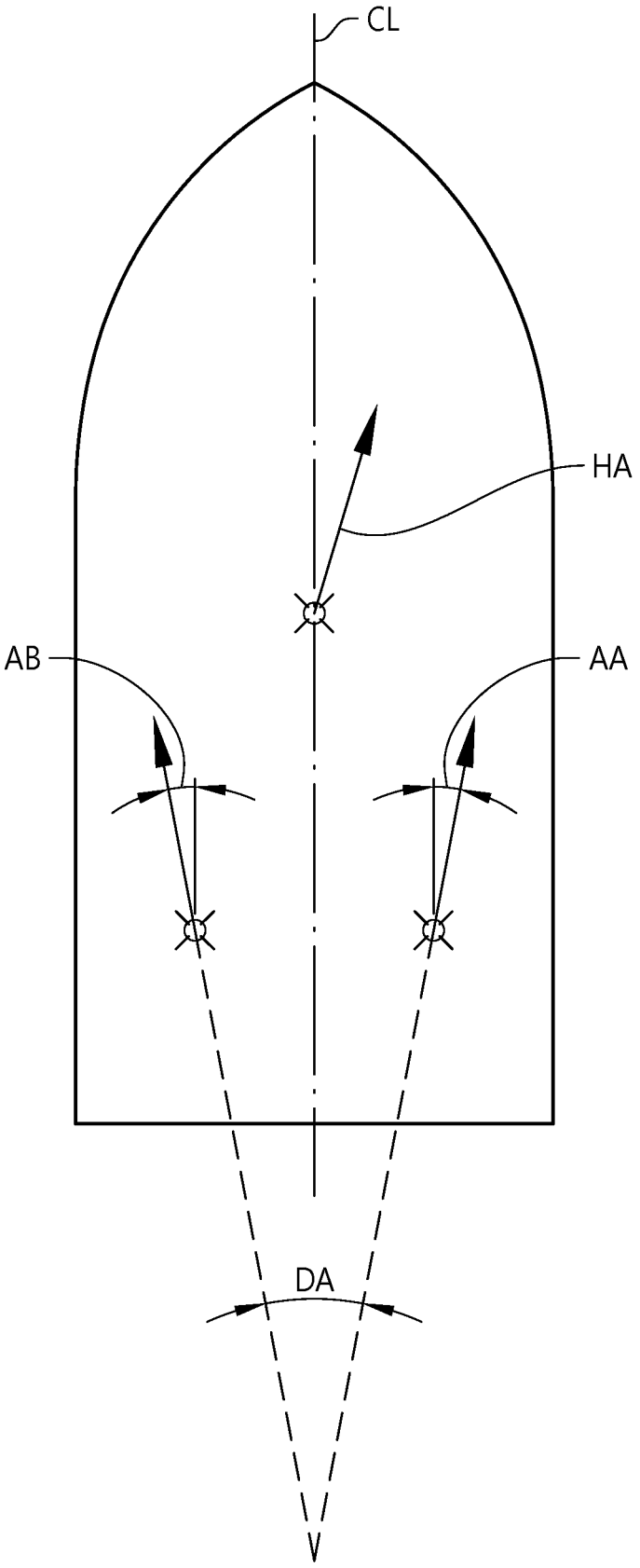
FIG. 4 is a view of the vessel in FIG. 1 from underneath, with arrows indicating directions of propulsion unit steering angles, and a course over ground of the vessel.

Reference is made to FIG. 4. The steering angle for the first propulsion unit 106 is indicated with an arrow AA, and the steering angle for the second propulsion unit 107 is indicated with an arrow AB. The steering angle AA, AB is in this example the angle of the propeller rotational axis of the respective propulsion unit to the hull centreline CL.

An actual course over ground of the vessel is indicated with an arrow HA. The actual course over ground HA may be at a non-zero angle to the hull centreline CL for a number of reasons, e.g. due to asymmetry, as exemplified above, water currents, or wind.

Figure 5:
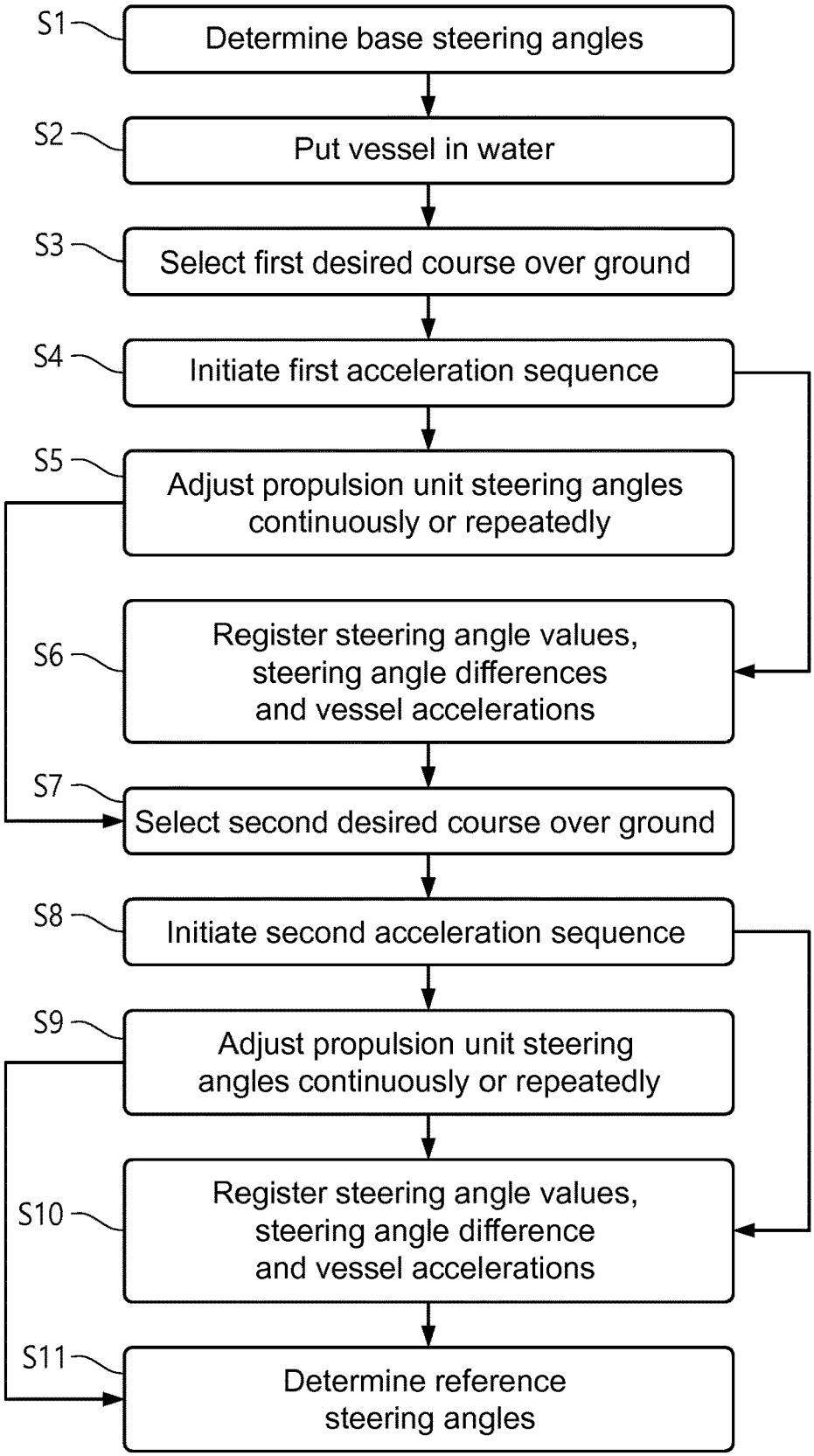
FIG. 5 is a block diagram depicting steps in a method performed in the vessel of FIG. 1.

Reference is made also to FIG. 5. The method comprises determining S1 a respective base steering angle AAC1, ABC1 of the propulsion units 106, 107, presumed to provide a straight path of travel of the vessel. The base steering angles AAC1, ABC1 form start centre positons for propulsion units. Each base steering angle AAC1, ABC1 may simply be a respective angular position which is midways between two extreme positions of the respective propulsion unit. This determination may be done, e.g. at the end of a production line of the vessel.

The base steering angles AAC1, ABC1 are stored in the storing means of the control unit 10, as indicated in the table in FIG. 6. As described below, the base steering angles are updated to reference steering angles, and in FIG. 6, base steering angles and reference steering angles used in the method are commonly denoted AAC and ABC.

The vessel 1 is put S2 in the water for the remainder of the calibration method. A first course over ground HD1 is selected S3 by the autopilot 11 as a desired course over ground HD. Subsequently, vessel 1 is steered at low speed in the first course over ground. A first acceleration sequence is initiated S4, in which the thrust of the propulsion units 106, 107 are continuously increased, so that the vessel gradually increases its speed. The point in time at the beginning of the commencement of the first acceleration sequence, for this example denoted t1, is registered by the control unit, as indicated in FIG. 6.

The actual course over ground HA of the vessel is continuously registered by the autopilot 11, and by the control unit 10. As the vessel speed is increasing the steering angles of the propulsion units 106, 107 are adjusted S5, continuously or repeatedly, to align the actual course over ground HA of the vessel with the first course over ground HD1. Thereby the steering angles of the propulsion units 106, 107 are adjusted to keep the path of the vessel straight during the first acceleration sequence.

The adjustment S5 of the propulsion units 106, 107 includes adjusting a difference DA, indicated in FIG. 4, of the steering angles of the first and second propulsion units 106, 107. Thereby, the adjustment of the steering angles of the propulsion units 106, 107, to keep the path of the vessel straight during the acceleration sequence, is at least partly done by the adjustment of the steering angle difference DA.

For example, when a deviation of the actual course over ground HA from the first course over ground HD1 is detected, the steering angle of the first propulsion unit 106 may be adjusted, so as to align the actual course over ground with the first course over ground HD1, while the steering angle of the second propulsion unit 107 is kept constant. When a subsequent deviation of the actual course over ground HA from the first course over ground HD1 is detected, the steering angle of the second propulsion unit 107 may be adjusted, so as to align the actual course over ground with the first course over ground HD1, while the steering angle of the first propulsion unit 106 is kept constant. Thus, the control unit 10 may be programmed to perform a sequence of steering angle adjustments, so that it is ensured that the steering angle difference DA is changed during the acceleration sequence.

During the acceleration sequence, a plurality of values AA, AB of the respective steering angles of the propulsion units 106, 107 are registered S6 as indicated in FIG. 6. The points in time t2, t3, . . . , at which the steering angle values AA, AB are registered, are also registered as indicated in FIG. 6.

Also, at each of said points in time t2, t3, . . . , the steering angle difference DA, is registered S6. In addition, at each of said points in time t2, t3, . . . , a value ACC of an operational parameter, which is dependent on the steering angle difference DA, is registered S6. In this embodiment, the operational parameter is the vessel acceleration ACC. In other embodiments, some other suitable parameter may form the operational parameter registered during the execution of the method, such as the rotational speed of one, or both, of the engines 206, 207, or a parameter indicative of the vessel acceleration, or the engine rotational speed.

When the first acceleration sequence is finalized, in this example when the top speed of the vessel 1 is reached, a second course over ground HD2 is selected S7 by the autopilot 11 as a desired course over ground HD. The second course over ground HD2 differs from the first course over ground HD1 by 180 degrees. Alternatively, the first and second courses over ground could differ by some other angle, e.g. 90 degrees or 120 degrees.

Subsequently, a second acceleration sequence is initiated S8. The point in time at the beginning of the commencement of the second acceleration sequence, for this example denoted T, is registered by the control unit, as indicated in FIG. 6.

Similarly to the first acceleration sequence, as the vessel speed is increasing the steering angles of the propulsion units 106, 107 are adjusted S9, continuously or repeatedly, to align the actual course over ground HA of the vessel with the second course over ground HD2. Also, similarly to the first acceleration sequence, the adjustment S9 of the propulsion units 106, 107 includes adjusting the difference DA, indicated in FIG. 4, of the steering angles of the first and second propulsion units 106, 107.

During the second acceleration sequence, propulsion unit steering angles AA, AB, steering angle differences DA, and vessel accelerations ACC are registered S10. Also, the points in time T+1, T+2, . . . , at which the steering angles AA, AB, steering angle differences DA, and vessel accelerations ACC are registered, are registered S10.

When the second acceleration sequence is finalized, reference steering angles AAC2, ABC2 of the propulsion units are determined S11 based on the propulsion unit steering angles AA, AB, the steering angle differences DA, and the vessel accelerations ACC, registered during the first and second acceleration sequences.

Determining S11 the respective reference steering angle AAC2, ABC2 comprises a statistical treatment of the registered steering angle values AA, AB. More specifically, determining the respective reference steering angle AAC2, ABC2 comprises weighting the registered steering angle values AA, AB, in dependence on respective deviations, at the registrations of the respective steering angle values AA, AB, from a straight path of the vessel. The deviations from the straight path of the vessel are calculated as the difference between the respective registered actual course over ground HA and the desired course over ground HD. Thereby, the reference steering angle AAC2, ABC2 may be determined so as to reduce, in relation to the base steering angle AAC1, ABC1, the deviation of the actual course over ground HA from the desired course over ground HD.

Determining the respective reference steering angles AAC2, ABC2 also comprises weighting the steering angle values AA, AB, in dependence on the respective acceleration value ACC. More specifically, acceleration values ACC, registered at different points in time t, at which the vessel speed is substantially the same, are compared. The compared acceleration values ACC may have been registered at a respective of the first and second acceleration sequences. The compared acceleration values ACC are registered at different steering angle differences DA. Thereby, the reference steering angles AAC2, ABC2 may be determined so as to provide a steering angle difference DA which provides accelerations throughout the entire speed range of the vessel, which are on average higher than the accelerations provided at other steering angle differences DA.

In alternative embodiments, instead of a continuous acceleration, one or more of the acceleration sequences may comprise a stepwise acceleration. Such an acceleration sequence may present repeated vessel accelerations, and intermediate intervals with a constant speed.

In the embodiment described above with reference to FIG. 5 and FIG. 6, the reference steering angles AAC2, ABC2 are determined after two acceleration sequences. Alternatively, the reference steering angles AAC2, ABC2 may be determined after more than two acceleration sequences. For example, the method could include three acceleration sequences with respective desired courses over ground, separated by 120 degrees. In a further alternative, the reference steering angles AAC2, ABC2 may be determined after only one acceleration sequence.

In alternative embodiments, the operational parameter used for determining the respective reference steering angles AAC2, ABC2, may be the vessel speed, or a parameter indicative of the vessel speed. Thereby, the reference steering angle determination may comprise comparing vessel speed values which are registered at different points in time t, at different steering angle differences DA, and at respective rotational speeds of one or both of the engines, which are substantially the same.

Figure 7:
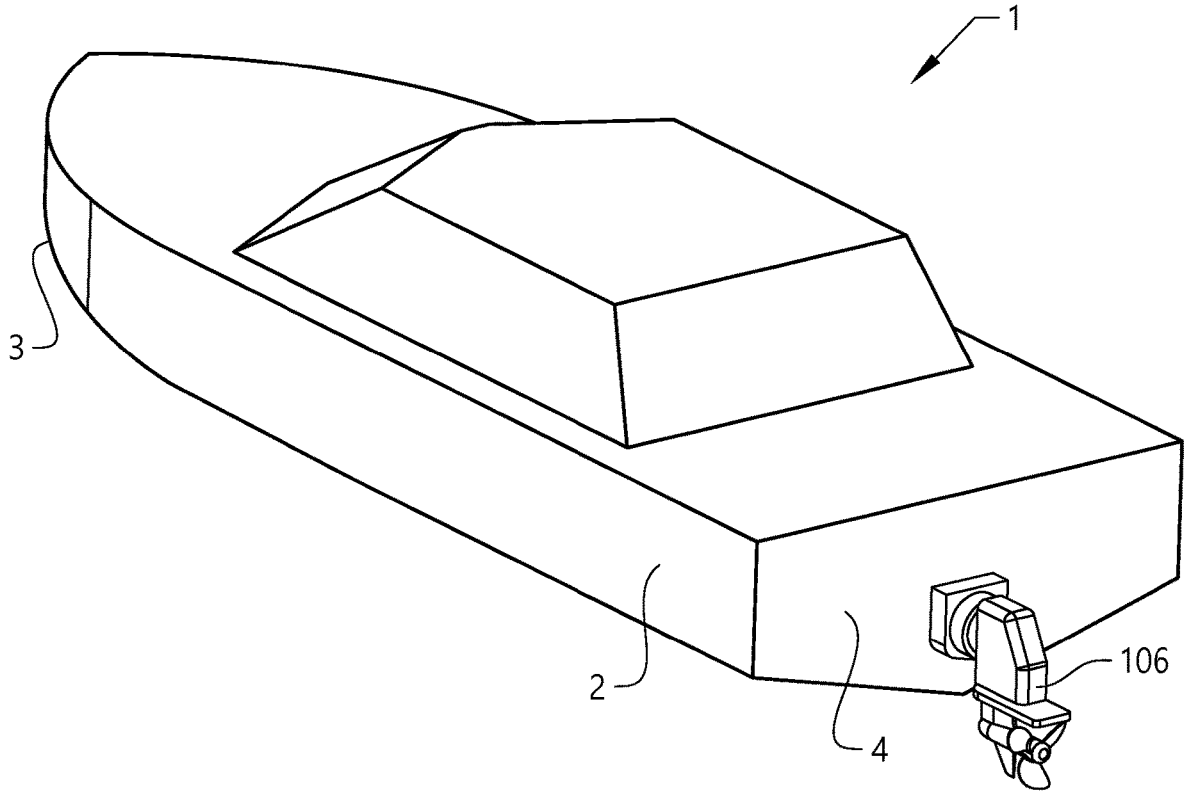
FIG. 7 is a perspective view of a marine vessel in which a method according to an alternative embodiment of the invention is executed.

The invention is applicable to vessels with any number of propulsion units. FIG. 7 shows a vessel 1 in the form of a power boat, with a single propulsion unit in the form of a stern drive 106. The vessel is provided with a marine propulsion control system 9, similar to the one described above with reference to FIG. 2, albeit for the single propulsion unit, arranged to be driven by a single engine.

Figure 8:
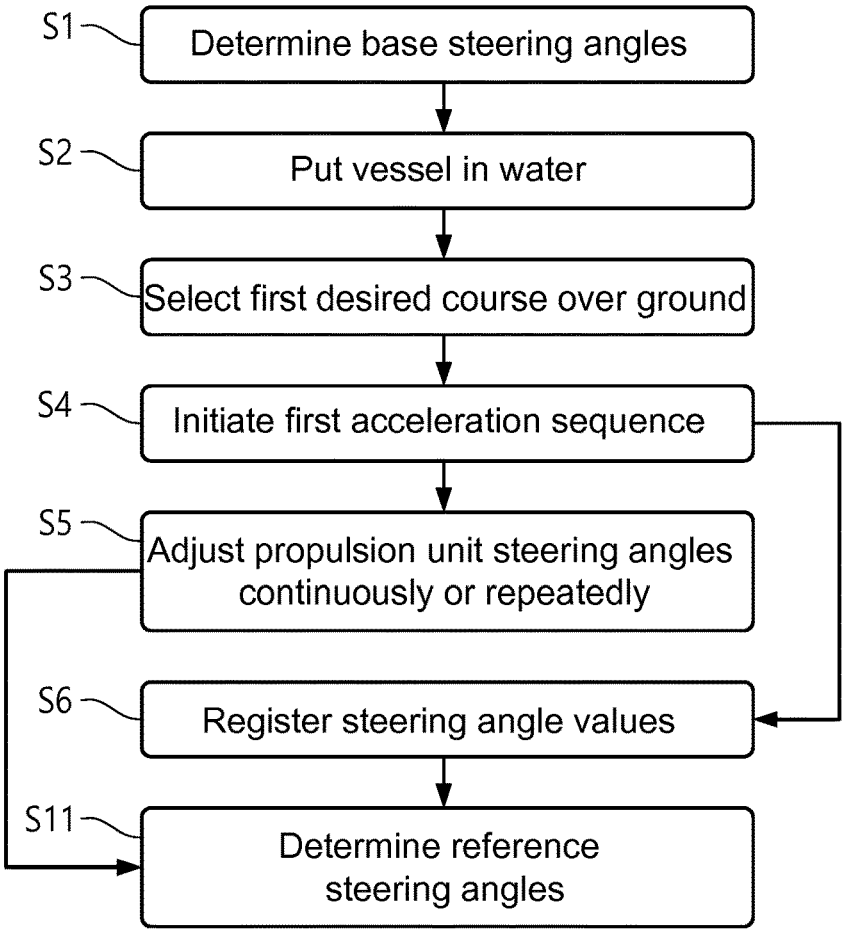
FIG. 8 is a block diagram depicting steps in the method performed in the vessel of FIG. 7.

Reference is made also to FIG. 8. A calibration method for the propulsion unit comprises determining S1 a respective base steering angle of the propulsion unit 106. The vessel 1 is put S2 in the water. A first course over ground HD1 is selected S3 by the autopilot of the vessel as a desired course over ground HD. Subsequently, a first acceleration sequence is initiated S4, in which the thrust of the propulsion unit 106 is continuously increased. The actual course over ground of the vessel is continuously registered by the autopilot, and by the control unit 10. As the vessel speed is increasing, the steering angle of the propulsion unit 106 is adjusted S5, continuously or repeatedly, to align the actual course over ground of the vessel with the first course over ground. During the acceleration sequence, a plurality of values of the steering angle of the propulsion unit 106 is registered S6. When the first acceleration sequence is finalized, a reference steering angle of the propulsion unit is determined S11 based on the registered propulsion unit steering angles. The determination S11 of the reference steering angle comprises weighting the registered steering angle values in dependence on respective deviations, at the registrations of the respective steering angle values, from a straight travelling path of the vessel.

A further embodiment of the invention will be described with reference to FIG. 9. Similarly to the embodiment described above with reference to FIG. 1-6, the method comprises executing a first and a second acceleration sequence, and, during the acceleration sequences, registering continuously the actual course over ground HA of the vessel, continuously or repeatedly adjusting the steering angles of the propulsion units 106, 107 to align the actual course over ground HA with the selected course over ground, and registering a plurality of values AA, AB of the respective steering angles of the propulsion units 106, 107.

Figure 9:
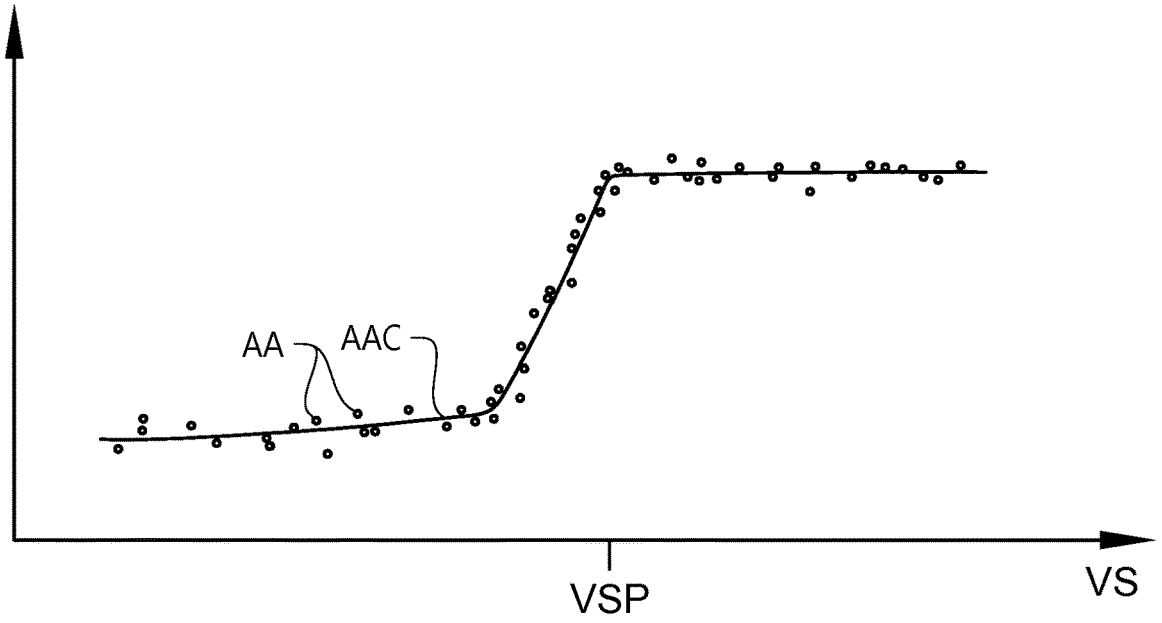
FIG. 9 shows a diagram mapping a reference steering angle to a vessel speed, according to a further embodiment of the invention.

With reference to FIG. 9, the determination of reference steering angles AAC for the first propulsion unit 106 will be described. The determination of reference steering angles ABC for the second propulsion unit 107 may be done in the same manner. Based on the registered first propulsion unit steering angle values AA, represented by dots in FIG. 9, an infinite amount of reference steering angles AAC are determined in the form of a curve, mapping the reference steering angles AAC to respective vessel speeds VS. The reference steering angles may be determined by a curve fitting algorithm of the registered steering angle values AA. It may be noted that in this example, the curve for the reference steering angles AAC presents a larger change that elsewhere in a speed region just below a lower end VSP of a planing mode speed interval of the vessel. This speed region may include a transition from a displacement mode to the planing mode.

It is to be understood that the present invention is not limited to the embodiments described above and illustrated in the drawings; rather, the skilled person will recognize that many changes and modifications may be made within the scope of the appended claims.

The invention claimed is:

1. A calibration method for at least one propulsion unit of a marine vessel, the at least one propulsion unit being arranged to provide a propulsive force to the vessel, the at least one propulsion unit being adjustable so as to change a respective steering angle of the at least one propulsion unit in relation to a hull of the vessel, the method comprising:

selecting a first course over ground as a desired course over ground;

controlling the at least one propulsion unit so as to provide at least one acceleration sequence, wherein the vessel is accelerated stepwise or continuously in each acceleration sequence, adjusting, continuously or repeatedly, during the acceleration sequence, the steering angle of the at least one propulsion unit, to align an actual course over ground of the vessel with the first course over ground to keep the path of the vessel straight during the acceleration sequence, registering, during the acceleration sequence, a plurality of values of the respective steering angle of the at least one propulsion unit, and determining, based at least partly on the registered steering angle values, a respective reference steering angle of the at least one propulsion unit, which reference steering angle minimizes a deviation of the actual course over ground of the vessel from the desired course over ground (HD) of the vessel.

2. A method according to claim 1, where the at least one propulsion unit is a pod drive, or a stern drive.

3. A method according to claim 1, further comprising determining the respective reference steering angle by a statistical treatment of the registered steering angle values.

4. A method according to claim 1, further comprising repeatedly or continuously registering changes of the actual course over ground of the vessel during the acceleration sequence.

5. A method according to claim 1, wherein determining the respective reference steering angle comprises weighting the registered steering angle values, in dependence on respective deviations, at the registrations of the respective steering angle values, from a straight path of the vessel.

6. A method according to claim 1, further comprising selecting a second course over ground different from the first course over ground, and adjusting, continuously or repeatedly, during a second acceleration sequence, the steering angle of the at least one propulsion unit to align the actual course over ground of the vessel with the second course over ground.

7. A method according to claim 1, where the marine vessel comprises a first propulsion unit and a second propulsion unit, characterized by adjusting, continuously or repeatedly, during at least one of the at least one acceleration sequence, a difference of the steering angles of the first and second propulsion units.

8. A method according to claim 7, wherein the adjustment of the steering angle of the propulsion units, to keep the path of the vessel straight during the acceleration sequence, is at least partly done by the adjustment of the steering angle difference.

9. A method according to claim 7, further comprising registering during the at least one of the at least one acceleration sequence a plurality of values of an operational parameter which is dependent on the steering angle difference, wherein the respective reference steering angles is determined based partly on the registered operational parameter values.

10. A method according to claim 9, wherein determining the respective reference steering angles comprises comparing the operational parameter values registered at different steering angle differences.

11. A method according to claim 9, wherein determining the respective reference steering angles comprises comparing operational parameter values which are registered at different points in time, at different steering angle differences, and at respective vessel speeds which are substantially the same.

12. A method according to claim 11, wherein the operational parameter is the vessel acceleration, the rotational speed of an internal combustion engine arranged to drive the first and/or the second propulsion unit, or a parameter indicative of the vessel acceleration, or the engine rotational speed.

13. A method according to claim 9, wherein determining the respective reference steering angles comprises comparing operational parameter values which are registered at different points in time, at different steering angle differences, and at respective rotational speeds of an internal combustion engine, or a drivetrain part, arranged to drive the first and/or the second propulsion unit which are substantially the same.

14. A method according to claim 13, further comprising the operational parameter is the vessel speed, or a parameter indicative of the vessel speed.

15. A method according to claim 9, further comprising selecting a first course over ground for a first acceleration sequence, and a second course over ground for a second acceleration sequence, wherein determining the respective reference steering angles comprises comparing operational parameter values which are registered at a respective of the first and second acceleration sequences.

16. A method according to claim 15, wherein the operational parameter values, which are registered at a respective of the first and second acceleration sequences, are registered at respective vessel speeds which are substantially the same.

17. A method according to claim 15, wherein the operational parameter values, which are registered at a respective of the first and second acceleration sequences, are registered at respective rotational speeds of an internal combustion engine, or a drivetrain part, arranged to drive the first and/or the second propulsion unit, which are substantially the same.

18. A method according to claim 9, wherein each of at least some of the operational parameter values are registered substantially simultaneously with the registration of a respective of at least some of the steering angle values.

19. A method according to claim 18, wherein determining the respective reference steering angles comprises weighting the steering angle values, in dependence on the respective operational parameter value registered substantially simultaneously with the registration of the respective steering angle value.

20. A method according to claim 1, further comprising determining, based at least partly on the registered steering angle values, a plurality of respective reference steering angles of the at least one propulsion unit, which reference steering angles minimizes, at a respective speed of the vessel, a deviation of an actual course over ground of the vessel from a desired course over ground of the vessel.

21. A computer program comprising program code for performing the steps of claim 1 when said program code is run on a computer.

22. A non-transitory computer readable medium carrying a computer program comprising program code for performing the steps of claim 1 when said program code is run on a computer.

23. A control unit configured to perform the steps of the method according to claim 1.

24. A marine propulsion control system comprising a control unit according to claim 23.

25. A marine vessel comprising a marine propulsion control system according to claim 24.

* * * * *